US007922500B2

(12) United States Patent
Komatsu et al.

(10) Patent No.: US 7,922,500 B2
(45) Date of Patent: Apr. 12, 2011

(54) ELECTRICAL CONNECTOR

(75) Inventors: Teppei Komatsu, Shinagawa-ku (JP); Koji Omori, Shibuya-ku (JP); Susumu Kawata, Shibuya-ku (JP)

(73) Assignee: Olympus Medical Systems Corp., Tokyo (JP)

( * ) Notice: Subject to any disclaimer, the term of this patent is extended or adjusted under 35 U.S.C. 154(b) by 0 days.

(21) Appl. No.: 12/507,028

(22) Filed: Jul. 21, 2009

(65) Prior Publication Data

US 2010/0029098 A1 Feb. 4, 2010

(30) Foreign Application Priority Data

Jul. 31, 2008 (JP) ..... 2008-198413

(51) Int. Cl.
*H01R 12/00* (2006.01)

(52) U.S. Cl. ..... 439/79

(58) Field of Classification Search ..... 439/79, 439/719, 941
See application file for complete search history.

(56) References Cited

U.S. PATENT DOCUMENTS

| | | | | |
|---|---|---|---|---|
| 5,975,944 | A | 11/1999 | Medina et al. | |
| 6,328,609 | B1 * | 12/2001 | Ezawa et al. | 439/676 |
| 7,070,424 | B2 * | 7/2006 | Obikane et al. | 439/74 |
| 2004/0043658 | A1 | 3/2004 | Ko | |
| 2007/0141867 | A1 * | 6/2007 | Kishi et al. | 439/74 |
| 2008/0085581 | A1 | 4/2008 | Kim et al. | |

FOREIGN PATENT DOCUMENTS

| | | |
|---|---|---|
| JP | 2002-214538 | 7/2002 |
| WO | WO 2006/055698 | 5/2006 |

* cited by examiner

*Primary Examiner* — Ross N Gushi
(74) *Attorney, Agent, or Firm* — Cohen Pontani Lieberman & Pavane LLP

(57) ABSTRACT

An electrical connector has a plurality of terminals arranged side-by-side in a horizontal direction. Each of the terminals has a first connection portion adapted to be connected with one of two members electrically connectable to each other via the electrical connector, and a second connection portion adapted to be connected with the other member. In the electrical connector, two or more first terminals consisting of a part of the terminals are arranged such that an inter-terminal pitch in the first connection portions thereof is equal to that in the second connection portions thereof, and two or more second terminals consisting of the remaining terminals other than the first terminals are arranged such that an inter-terminal pitch in the first connection portions thereof is less than that in the second connection portions thereof.

15 Claims, 6 Drawing Sheets

ELECTRICAL CONNECTOR

BACKGROUND OF THE INVENTION

1. Field of the Invention

The present invention relates to an electrical connector, and more particularly to an electrical connector designed to change an inter-terminal pitch.

2. Description of the Background Art

In an electrical connector for use in medical apparatuses or the like, there are some cases in which only a specific part of a plurality of terminals are required to be compatible with high-speed transmission, as a particular usage mode. However, in a conventional electrical connector, a plurality of terminals are produced to have the same dimensions and the same configuration, and arranged at the same pitch, as disclosed, for example, in JP 2002-214538A. Thus, even if such terminals are designed as a type compatible with high-speed transmission (hereinafter referred to as "high-speed transmission terminal"), there occurs a problem of being unable to maintain satisfactory quality as high-speed transmission characteristics, or of causing an increase in overall size of the connector because all of the terminals are formed as high-speed transmission terminals

[Patent Document 1] JP 2002-214538A

SUMMARY OF THE INVENTION

In view of the above problem in the conventional electrical connector, it is an object of the present invention to provide an electrical connector capable of achieving satisfactory high-speed transmission characteristics, while facilitating a reduction in overall size thereof, in such a manner that a part of a plurality of terminals are defined as high-speed transmission terminals, i.e., distinguished from the remaining normal terminals, and designed to have a terminal configuration and a pitch dimension which satisfy a desired characteristic impedance.

In order to achieve the above object, according to one aspect of the present invention, there is provided an electrical connector which comprises a plurality of terminals arranged side-by-side in a horizontal direction, wherein each of the terminals has a first connection portion adapted to be connected with one of two members electrically connectable to each other via the electrical connector, and a second connection portion adapted to be connected with the other member. In the electrical connector, two or more first terminals consisting of a part of the terminals are arranged such that an inter-terminal pitch in the first connection portions thereof is equal to that in the second connection portions thereof, and two or more second terminals consisting of the remaining terminals other than the first terminals are arranged such that an inter-terminal pitch in the first connection portions thereof is less than that in the second connection portions thereof.

In the electrical connector of the present invention, the plurality of terminals may include an upper array of terminals arranged side-by-side in a horizontal direction, and a lower array of terminals arranged side-by-side in a horizontal direction and disposed on a lower side of the upper array in a vertical direction, wherein each of the terminals of the upper and lower arrays has a first connection portion adapted to be connected with one of two members electrically connectable to each other via the electrical connector, and a second connection portion adapted to be connected with the other member, and wherein: two or more first terminals consisting of a part of the terminals of the upper array are arranged such that an inter-terminal pitch in the first connection portions thereof is equal to that in the second connection portions thereof; two or more second terminals consisting of the remaining terminals of the upper array other than the first terminals are arranged such that an inter-terminal pitch in the first connection portions thereof is less than that in the second connection portions thereof; and all the terminals of the lower array are arranged such that an inter-terminal pitch in the first connection portions thereof is less than that in the second connection portions thereof.

Preferably, in the electrical connector of the present invention, each of the first terminals linearly extends between the first and second connection portions thereof in a horizontal direction, and each of the second terminals has a bent portion which is bent between the first and second connection portions thereof in the horizontal direction.

Preferably, in the electrical connector of the present invention, each of the terminals has an obtusely inclined portion which is obtusely inclined between the first and second connection portions thereof in a vertical direction.

Preferably, in the above electrical connector, the first terminals are disposed in a central region, and the second terminals are disposed on opposite sides of the central region.

Preferably, in the above electrical connector, each of the first terminals has a width in the horizontal direction greater than that of each of the second terminals.

In the electrical connector of the present invention, each of the first terminals may be a high-speed transmission terminal.

In the above electrical connector, when the first terminals include a pair of terminals adapted to be used for differential transmission, each of the pair of terminals preferably has a same length.

In the electrical connector of the present invention, when the first connection portion is used as a wire connection portion, and the second connection portion is used as a terminal contact portion, each of the terminals, except the wire connection portions and the terminal contact portions, is preferably covered by molding resin to form an air sealed structure.

According to a second aspect of the present invention, there is provided an electrical connector which comprises: an array of terminals arranged side-by-side in a horizontal direction, wherein each of the terminals of the array has a first connection portion adapted to be connected with a first one of two members electrically connectable to each other via the electrical connector, and a second connection portion adapted to be connected with the other, second, member; and a grounding plate. In the electrical connector, two or more first terminals consisting of a part of the terminals of the array are arranged such that an inter-terminal pitch in the first connection portions thereof is equal to that in the second connection portions thereof, and two or more second terminals consisting of the remaining terminals of the array other than the first terminals are arranged such that an inter-terminal pitch in the first connection portions thereof is less than that in the second connection portions thereof. Further, the first member includes a printed circuit board, and an external shell attached to the printed circuit board. The electrical connector is designed such that, when the first member is attached to the electrical connector, the first connection portions of the terminals of the array are brought into contact with the printed circuit board, and the grounding plate is brought into contact with the external shell in a vicinity of the first connection portions of the terminals of the array so as to be connected to ground.

DESCRIPTION OF THE PREFERRED EMBODIMENTS

With reference to the accompanying drawings, the present invention will now be described based on one preferred embodiment thereof.

Figure 1:
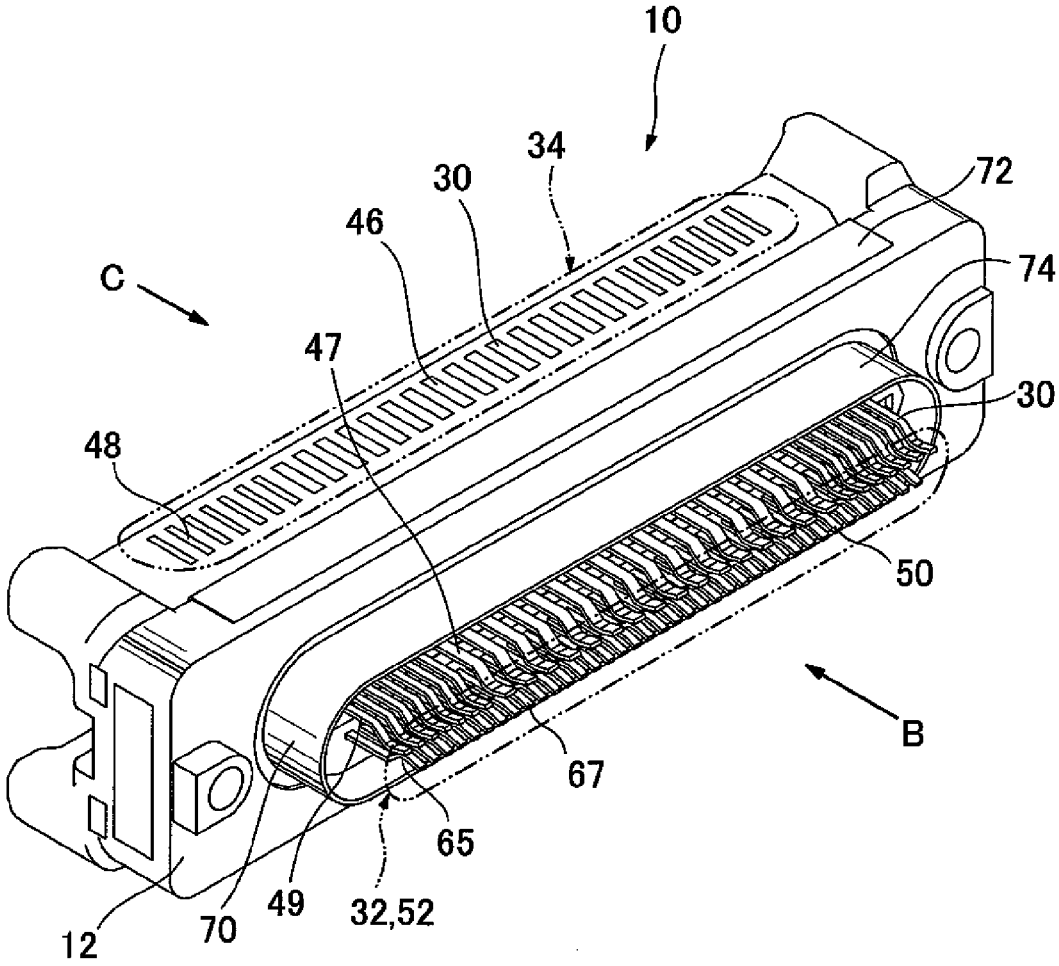
FIG. 1 is a perspective view showing an electrical connector according to one embodiment of the present invention.
Figure 2:
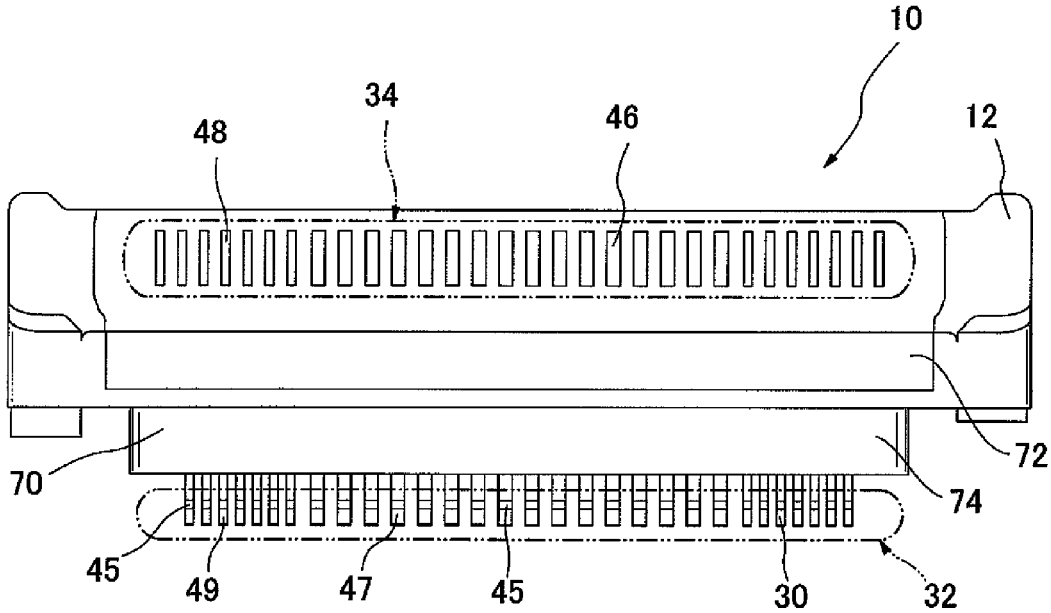
FIG. 2 is a top view showing the electrical connector in FIG. 1.
Figure 3:
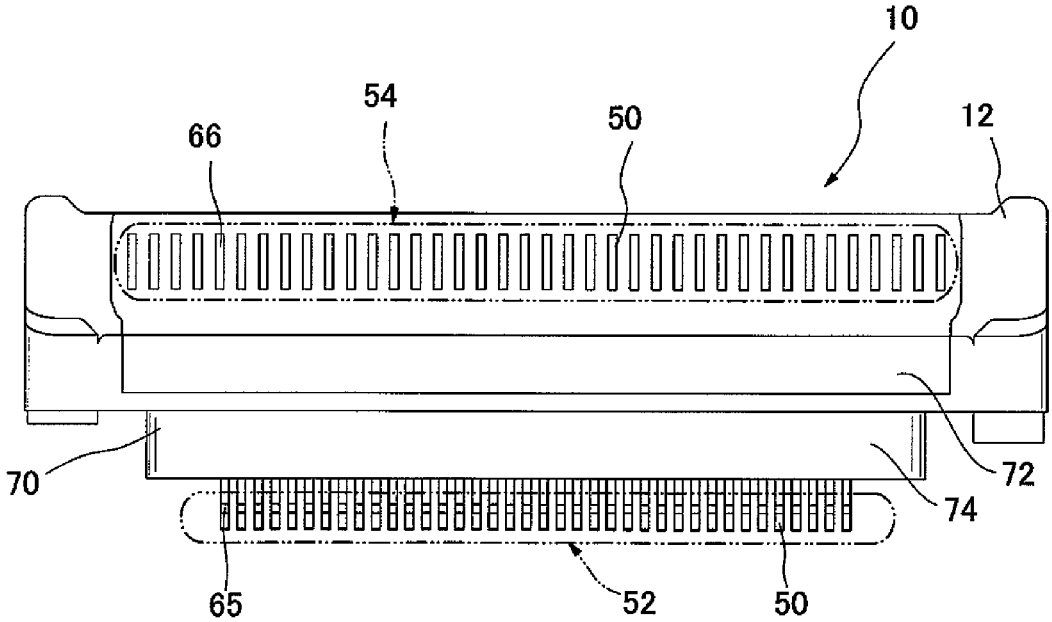
FIG. 3 is a bottom view showing the electrical connector in FIG. 1.

FIG. 1 is a perspective view showing an electrical connector 10 according to one embodiment of the present invention. FIGS. 2 and 3 are a top view and a bottom view of the electrical connector 10, respectively. the electrical connector 10 comprises a housing 12, an upper array of terminals 30 and a lower array of terminals 50 which are integrally molded with the housing 12, and grounding plate 70. For easy understanding, the lower array of terminals 50 is omitted in FIG. 2, and the upper array of terminals 30 is omitted in FIG. 3.

Figure 4:
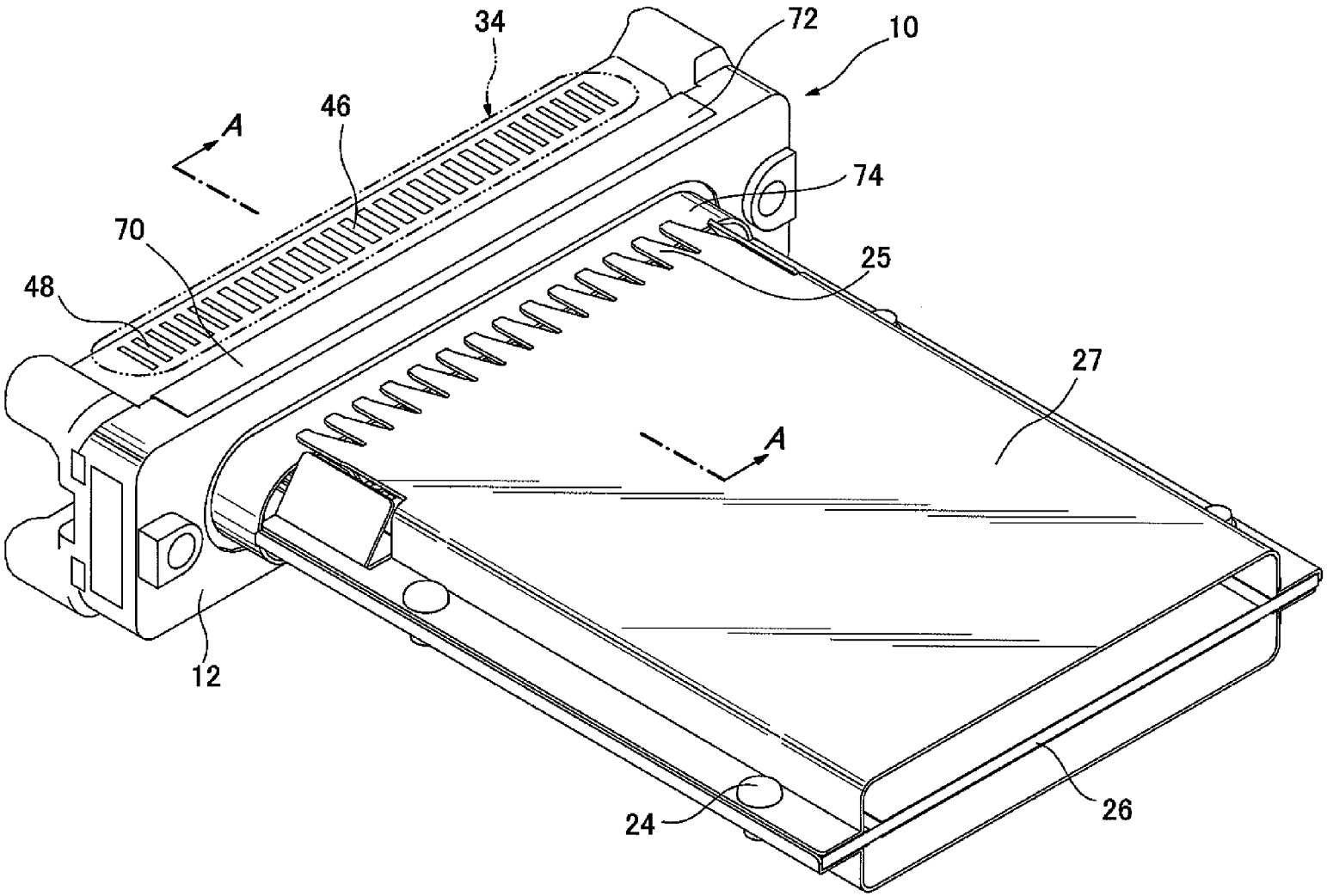
FIG. 4 is a perspective view showing the electrical connector in FIG. 1 together with a member attached thereto.

The electrical connector 10 is adapted to allow a first member comprising an after-mentioned printed circuit board 26 and an after-mentioned external shell 27 to be connected thereto from the arrowed direction B in FIG. 1, and allow a second member comprising a counterpart connector (not shown) to be connected thereto from the arrowed direction C in FIG. 1. The first and second members are electrically connectable to each other through the terminal 30, 50 when they are connected to the electrical connector 10. FIG. 4 shows the first member in a state after being connected to the electrical connector 10 from the direction B, and FIG. 5 is a schematic sectional view taken along the line A-A in FIG. 4.

The first member to be connected to the electrical connector 10 from the direction B comprises a printed circuit board 26, and an external shell 27 attached to the printed circuit board 26 by a screw. When the first member is connected to the electrically connector 10, the printed circuit board 26 is clamped between respective ones of after-mentioned wire connection portions (serving as first connection portions) 32 of the terminals 30 and after-mentioned wire connection portions (serving as first connection portions) 52 of the terminals 50 with a given contact pressure, and a plurality of tongue pieces 25 of the external shell 27 (which is illustrated only in FIG. 4, and omitted in FIG. 5) are brought into contact with a lower exposed portion 74 of the grounding plate 70 provided to protrude from the housing 12 in the same direction as that of the terminals 30, 50 and externally surround respective portions of the terminals 30, 50 adjacent thereto, i.e., respective exposed portions of the terminals 30, 50, so that the external shell 27 is connected to ground together with the printed circuit board 26. The external shell 27 makes it possible to shield the printed circuit board 26, and maintain high-speed transmission as an assembly. One end of an electrical wire (not shown) is connected to a far side of the printed circuit board 26 relative to the electrical connector 10. The electric wire has the other end connected to another device.

Figure 5:
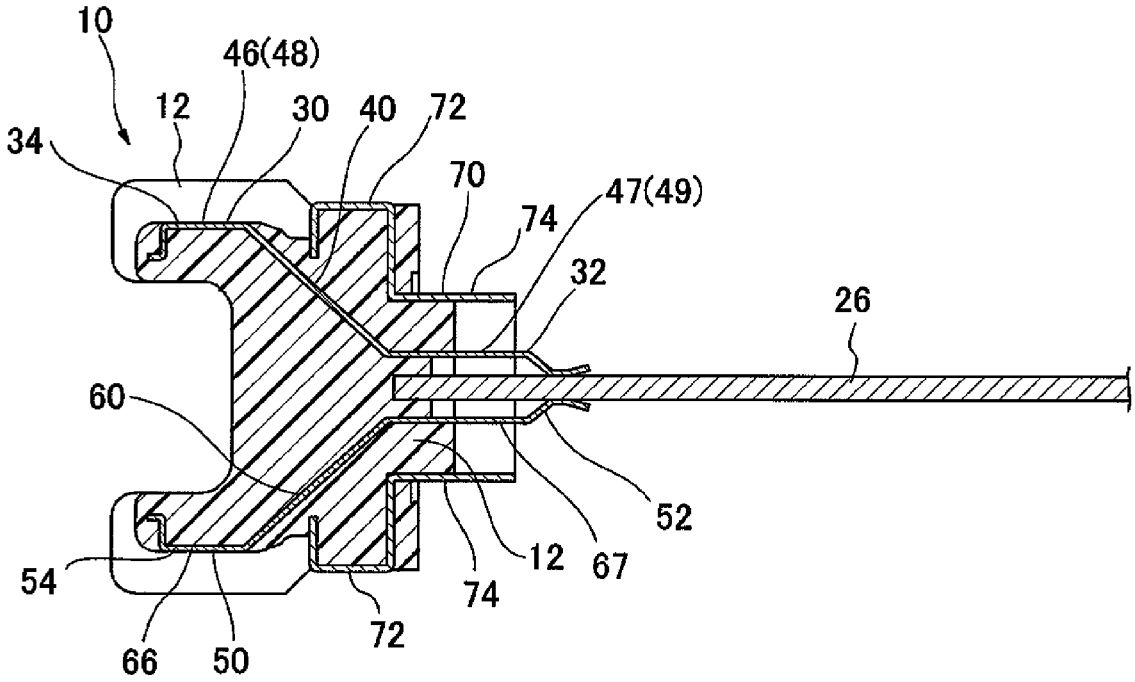
FIG. 5 is a sectional view taken along the line A-A in FIG. 4.

Although the second member to be connected to the electrical member 10 from the direction C is not illustrated, it may be considered that the second member has the same function as that of the first member illustrated in FIGS. 4 and 5. Specifically, the second member comprises a main body and an external shell. The main body is adapted to be brought into contact with after-mentioned terminal contact portions (serving as second contact portions) 34 of the terminals 30 and after-mentioned terminal contact portions (serving as second contact portions) 54 of the terminals 50, i.e., externally exposed portions 46, 48 of the terminals 30 and externally exposed portions 66 of the terminals 50, and the external shell is adapted to be brought into contact with an upper exposed portion 72 of the grounding plate 70 so as to be connected to ground. The upper exposed portion 72 and the lower exposed portion 74 are connected to each other inside the housing 12, and therefore may be considered as being electrically integral with each other.

Figure 6:
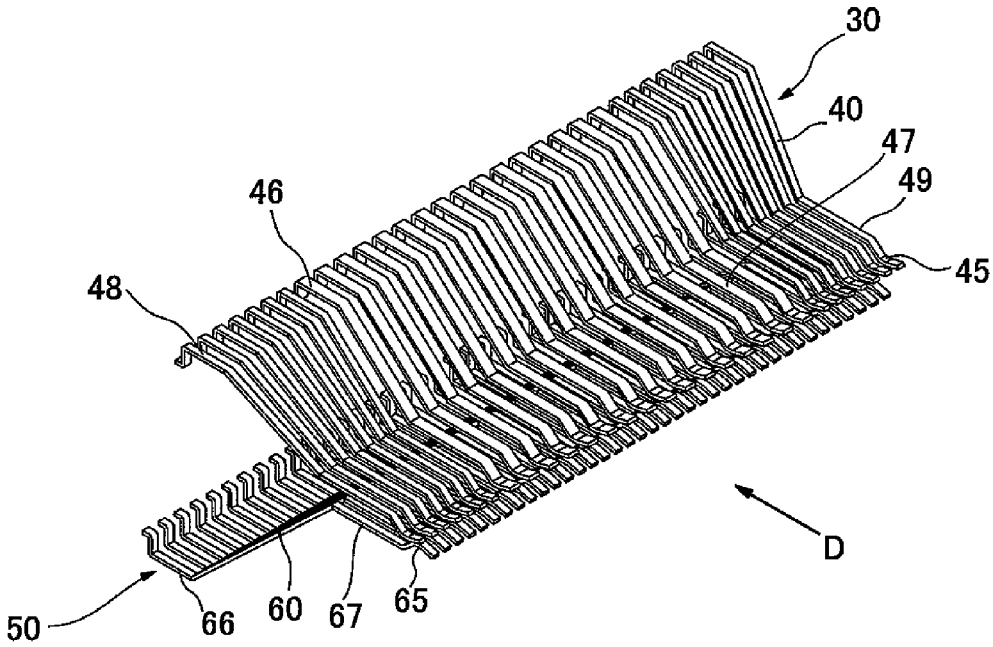
FIG. 6 is a perspective view showing an upper array of terminals and a lower array of terminals.
Figure 7:
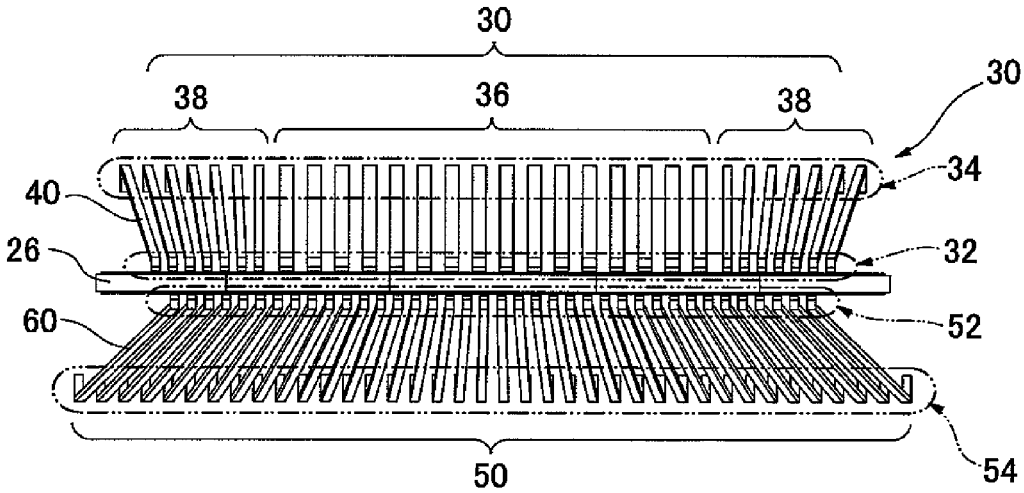
FIG. 7 is a front view showing the upper array of terminals and the lower array of terminals.
Figure 8:
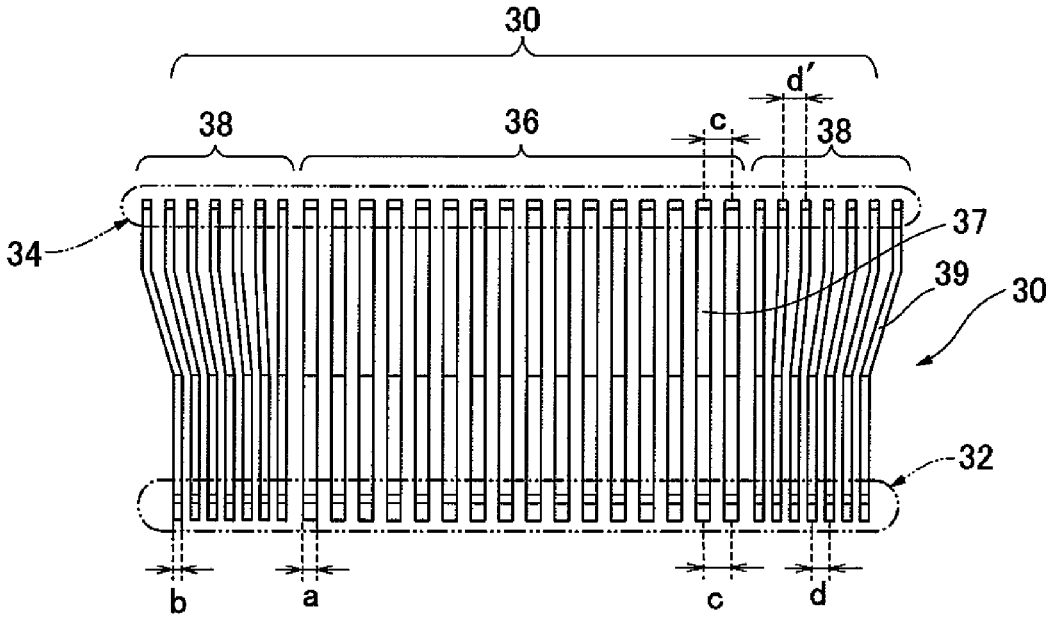
FIG. 8 is a top view showing only the upper array of terminals.
Figure 9:
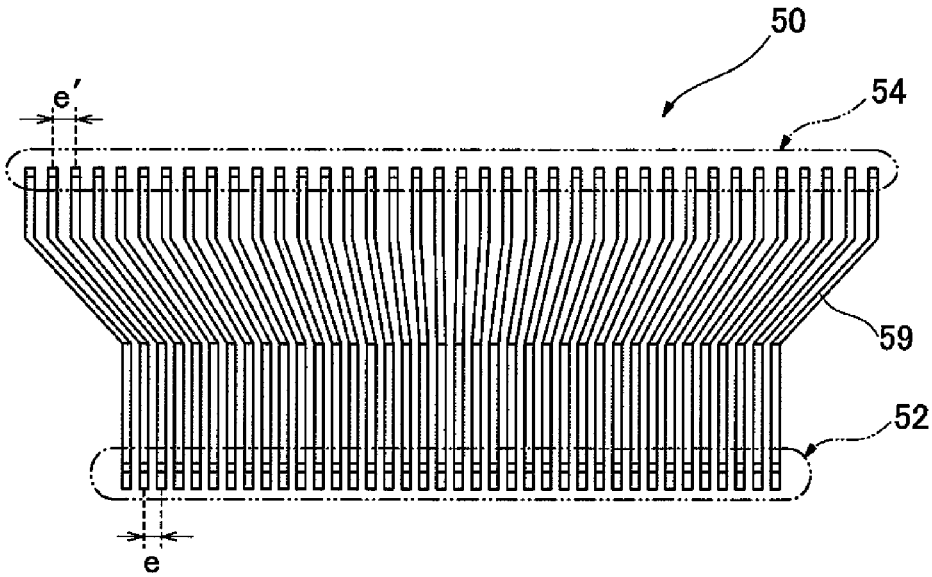
FIG. 9 is a top view showing only the lower array of terminals.

With reference to FIGS. 6 and 9, an arrangement of the upper array of terminals 30 and the lower array of terminals 50 will be described below. FIG. 6 is a perspective view showing the arrangement of the upper array of terminals 30 and the lower array of terminals 50 in the electrical connector 10, wherein the housing 12 is removed for the sake of illustrative convenience. FIG. 7 is a front view showing the upper array of terminals 30 and the lower array of terminals 50 (together with the printed circuit board 26 for reference), when viewed in the arrowed direction D in FIG. 6. FIG. 8 is a top view showing only the upper array of terminals 30, and FIG. 9 is a top view showing only the lower array of terminals 50.

As is clearly shown in FIGS. 6 to 9, the terminals 30 of the upper array are arranged side-by-side in a horizontal direction, and the terminals 50 of the lower array are also arranged side-by-side in a horizontal direction and disposed under the terminals 30 of the upper array in a vertical direction. Each of the terminals 30 of the upper array has a first connection portion (wire connection portion) 32 and a second connection portion (terminal contact portion) 34, and each of the terminals 50 of the lower array has a first connection portion (wire connection portion) 52 and a second connection portion (terminal contact portion) 54. Each of the terminals 30 of the upper array has a step between the first and second connection portions 32, 34, and each of the terminals 50 of the lower array has a step between the first and second connection portions 52, 54. In order to compensate for the step, each of the terminals 30 of the upper array has an obtusely inclined portion 40 which is obtusely inclined between the first and second connection portions 32, 34 thereof in a vertical direction, and each of the terminals 50 of the upper array has an obtusely inclined portion 60 which is obtusely inclined between the first and second connection portions 52, 54 thereof in the vertical direction. Generally, bending into a crank-like shape at 90 degrees has adverse effects on high-speed transmission characteristics. In contrast, each of the obtusely inclined portions 40, 60 is formed to have a smooth inclined surface to effectively prevent deterioration in the high-speed transmission characteristics.

It should be noted that the terminals 30 of the upper array consist of two types of terminals: two or more high-speed transmission terminals 36 adapted to be used for high-speed transmission, and the remaining normal terminals 38 other than the high-speed transmission terminals 36. Differently from the terminals 30 of the upper array, the terminals 50 of the lower array consist only of terminals corresponding to the normal terminals 38 in the terminals 38 of the upper array.

Each of the high-speed transmission terminals 36 included in the terminals 30 of the upper array is formed to have the same overall length and the same thickness in order to maintain high-speed transmission characteristics. Further, each of the high-speed transmission terminals 36 is formed to have a width dimension a in the horizontal direction greater than a width dimension b of each of the normal terminals 38 in the horizontal direction. The width dimension a is an optimal value derived from electrical properties of a material selected for the terminals 30 of the upper array.

The high-speed transmission terminals 36 included in the terminals 30 of the upper array are arranged such that an inter-terminal pitch c in the first connection portion 32 thereof, i.e., a distance between respective centers of adjacent ones thereof, is equal to an inter-terminal pitch c in the second connection portions 34 thereof. That is, in the high-speed transmission terminals 36, an inter-terminal pitch in the wire connection portions is not changed from that in the terminal contact portions (terminal fitting portions). Further, each of the high-speed transmission terminals 36 is a linear-shaped terminal 37 which linearly extends between the first and second connection portions 32, 34 in the horizontal direction. The linear-shaped high-speed transmission terminals 36 make it possible to more effectively prevent deterioration in the high-speed transmission characteristics. In cases where the high-speed transmission terminals 36 are used particularly for differential transmission, each of the high-speed transmission terminals 36 is required to have the same length. In such cases, the linear-shaped high-speed transmission terminals 36 make it possible to facilitate design for differential transmission.

Differently from the high-speed transmission terminals 36, the normal terminals 38 included in the terminals 30 of the upper array together with the high-speed transmission terminals 36 are arranged such that an inter-terminal pitch d in the first connection portions 32 thereof is less than an inter-terminal pitch d' in the second connection portions 34 thereof. That is, in the normal terminals 38, the respective inter-terminal pitches in the first and second connection portions 32, 34 are different from each other. Thus, in order to compensate for the difference in the inter-terminal pitch, each of the normal terminals 38 is provided with a bent portion 39 which is bent between the first and second connection portions 32, 34 in the horizontal direction. As for a bending angle of each of the bent portions 39, the normal terminal 38 located closer to a center of the upper array in the horizontal direction has a smaller bending angle, and the normal terminal 38 located closer to each of opposite edges of the upper array in the horizontal direction has a larger bending angle.

As described above, in the terminals 30 of the upper array, the high-speed transmission terminals 36 are distinguished from the remaining normal terminals 38, so as to satisfy a desired characteristic impedance. Further, in the terminals 30 of the upper array, the high-speed transmission terminals 36 are mixed with the normal terminals 38 in such a manner that the high-speed transmission terminals 36 are arranged to have an inter-terminal pitch different from that of the normal terminals 38, instead of forming all the terminals 30 as the high-speed transmission terminals 36. This makes it possible to facilitate reduction in overall size of the electrical connector, allow a larger number of terminals to be arranged within an existing limited terminal arrangement area (e.g., 50-pin area). Further, each of the high-speed transmission terminals 36 is formed to have the same length and a linear shape in consideration of differential signals and others and arranged in a central region of the electrical connector (a central region of the upper array) in paired relation with a ground terminal, and the normal terminals 38 are disposed on opposite sides of the central region in such a manner to reduce a horizontal distance on the side of the printed circuit board. This makes it possible to increase the number of contacts while maintaining an existing plug size, without spoiling the high-speed transmission characteristics. Further, the wire connection portions of the linear-shaped high-speed transmission terminals 36 and the normal terminals 38 having the reduced inter-terminal pitch can cope with a need for using a printed circuit board having the same size of an existing lower array of terminals 50.

Differently from the terminals 30 of the upper array which comprise two types of terminals consisting of the high-speed transmission terminals 36 and the normal terminals 30, the terminals 50 of the lower array consisting only of the normal terminals are arranged such that an inter-terminal distance e in the first connection portions 52 thereof is less than an inter-terminal distance e' in the second connection portions 54 thereof, in the same manner as that in the normal terminals 38 included in the terminals 30 of the upper array. That is, the respective inter-terminal pitched in the first and second connection portions 52, 54 are different from each other. Thus, in order to compensate for the difference in the inter-terminal pitch, each of the normal terminals, except a central one thereof, is provided with a bent portion 59 which is bent between the first and second connection portions 52, 54 in the horizontal direction, in the same manner as that in the normal terminals 38 included in the terminals 30 of the upper array. As seen in FIG. 9, the normal terminal located closer to a center of the lower array in the horizontal direction has a smaller bending angle, and the normal terminal located closer to each of opposite edges of the lower array in the horizontal direction has a larger bending angle.

For example, in cases where the electrical connector according to this embodiment is used for a medical apparatus or the like, water or blood is likely to attach thereon to give rise to a need for cleaning. Thus, it is desirable to enhance waterproofing property thereof. For this purpose, each of the terminals of the upper and lower arrays, except the wire connection portions 32, 52 (first connection portions) and the terminal contact portions 34, 54 (second connection portions), may be substantially fully covered by molding resin 12 to form a hermetic or air sealed structure. Further, in order to maintain a sealing performance, each of the terminals of the upper and lower arrays, except the terminal contact potions between respective ones of the terminals of the electrical connector and terminals of a counterpart connector, and the wire connection portions with the printed circuit board (or electrical wires) may be substantially fully covered by molding resin to form a single-piece structure.

What is claimed is:

1. An electrical connector comprising a plurality of terminals arranged side-by-side in a horizontal direction, each of the terminals having a first connection portion adapted to be connected with one of two members electrically connectable to each other via the electrical connector, and a second connection portion adapted to be connected with the other of the two members, wherein:

the plurality of terminals include an upper array of terminals arranged side-by-side in the horizontal direction, and a lower array of terminals arranged side-by-side in the horizontal direction and disposed on a lower side of the upper array in a vertical direction, each of the terminals of the upper and lower arrays having a first connection portion adapted to be connected with one of the two members electrically connectable to each other via the electrical connector, and a second connection portion adapted to be connected with the other member;

two or more first terminals consisting of a part of the terminals of the upper array are arranged such that an inter-terminal pitch in the first connection portions thereof is equal to that in the second connection portions thereof;

two or more second terminals consisting of the remaining terminals of the upper array other than the first terminals are arranged such that an inter-terminal pitch in the first connection portions thereof is less than that in the second connection portions thereof; and all the terminals of the lower array are arranged such that an inter-terminal pitch in the first connection portions thereof is less than that in the second connection portions thereof.

2. The electrical connector as defined in claim 1, wherein each of the first terminals linearly extends between the first and second connection portions thereof in the horizontal direction, and each of the second terminals has a bent portion which is bent between the first and second connection portions thereof in the horizontal direction.

3. The electrical connector as defined in claim 2, wherein the first terminals are disposed in a central region, and the second terminals are disposed on opposite sides of the central region.

4. The electrical connector as defined in claim 3, wherein each of the first terminals has a width in the horizontal direction greater than that of each of the second terminals.

5. The electrical connector as defined in claim 1, wherein each of the terminals has an obtusely inclined portion which is obtusely inclined between the first and second connection portions thereof in a vertical direction.

6. The electrical connector as defined in claim 1, wherein each of the first terminals is a high-speed transmission terminal.

7. The electrical connector as defined in claim 6, wherein the first terminals include a pair of terminals adapted to be used for differential transmission, each of the pair of terminals having a same length.

8. The electrical connector as defined in claim 1, wherein the first connection portion is configured as a wire connection portion, and the second connection portion is configured as a terminal contact portion, and wherein each of the terminals, except the wire connection portions and the terminal contact portions, is covered by molding resin to form an air sealed structure.

9. An electrical connector comprising: an array of terminals arranged side-by-side in a horizontal direction, each of the terminals of the array having a first connection portion adapted to be connected with a first one of two members electrically connectable to each other via the electrical connector, and a second connection portion adapted to be connected with a second one of the two members; and a grounding plate, wherein:

two or more first terminals consisting of a part of the terminals of the array are arranged such that an inter-terminal pitch in the first connection portions thereof is equal to that in the second connection portions thereof;

two or more second terminals consisting of the remaining terminals of the array other than the first terminals are arranged such that an inter-terminal pitch in the first connection portions thereof is less than that in the second connection portions thereof; and the first member includes a printed circuit board, and an external shell attached to the printed circuit board, wherein the electrical connector is designed such that, when the first member is attached to the electrical connector, the first connection portions of the terminals of the array are brought into contact with the printed circuit board, and the grounding plate is brought into contact with the external shell in a vicinity of the first connection portions of the terminals of the array so as to be connected to ground.

10. An electrical connector comprising a plurality of terminals arranged side-by-side in a horizontal direction, each of the terminals having a first connection means for connecting with one of two members electrically connectable to each other via the electrical connector, and a second connection means for connecting with the other of the two members, wherein:

two or more first terminals consisting of a part of the terminals are arranged such that an inter-terminal pitch in the first connection means is equal to that in the second connection means;

two or more second terminals consisting of the remaining terminals other than the first terminals are arranged such that an inter-terminal pitch in the first connection means is less than that in the second connection means;

the plurality of terminals include an upper array of terminals arranged side-by-side in the horizontal direction, and a lower array of terminals arranged side-by-side in the horizontal direction and disposed on a lower side of the upper array in a vertical direction, each of the terminals of the upper and lower arrays having a first connection portion adapted to be connected with one of two members electrically connectable to each other via the electrical connector, and a second connection portion adapted to be connected with the other member;

two or more first terminals consisting of a part of the terminals of the upper array are arranged such that an inter-terminal pitch in the first connection portions thereof is equal to that in the second connection portions thereof;

two or more second terminals consisting of the remaining terminals of the upper array other than the first terminals are arranged such that an inter-terminal pitch in the first connection portions thereof is less than that in the second connection portions thereof; and all the terminals of the lower array are arranged such that an inter-terminal pitch in the first connection portions thereof is less than that in the second connection portions thereof.

11. An electrical connector comprising a plurality of terminals arranged side-by-side in a horizontal direction, each of the terminals having a first connection portion adapted to be connected with one of two members electrically connectable to each other via the electrical connector, and a second connection portion adapted to be connected with the other of the two members, wherein:

two or more first terminals of the terminals are arranged such that an inter-terminal pitch in the first connection portions thereof is equal to that in the second connection portions thereof;

two or more second terminals of the remaining terminals other than the first terminals are arranged such that an inter-terminal pitch in the first connection portions thereof is less than that in the second connection portions thereof;

each of the first terminals linearly extends between the first and second connection portions thereof in the horizontal direction, and each of the second terminals has a bent portion which is bent between the first and second connection portions thereof in the horizontal direction;

the first terminals are disposed in a central region, and the second terminals are disposed on opposite sides of the central region; and each of the first terminals has a width in the first direction greater than that of each of the second terminals.

12. The electrical connector as defined in claim 11, wherein each of the terminals has an obtusely inclined portion which is obtusely inclined between the first and second connection portions thereof in a vertical direction.

13. The electrical connector as defined in claim 11, wherein each of the first terminals is a high-speed transmission terminal.

14. The electrical connector as defined in claim 13, wherein the first terminals include a pair of terminals adapted to be used for differential transmission, each of the pair of terminals having a same length.

15. The electrical connector as defined in claim 11, wherein the first connection portion is configured as a wire connection portion, and the second connection portion is configured as a terminal contact portion, and wherein each of the terminals, except the wire connection portions and the terminal contact portions, is covered by molding resin to form an air sealed structure.

* * * * *